US009055804B2

(12) United States Patent
Ornoski et al.

(10) Patent No.: US 9,055,804 B2
(45) Date of Patent: Jun. 16, 2015

(54) COSMETIC APPLICATOR

(75) Inventors: Gregory A. Ornoski, Teaneck, NY (US); Marisol Simard, Upper Nyack, NY (US)

(73) Assignee: Avon Products, Inc., New York, NY (US)

( * ) Notice: Subject to any disclaimer, the term of this patent is extended or adjusted under 35 U.S.C. 154(b) by 136 days.

(21) Appl. No.: 13/152,324

(22) Filed: Jun. 3, 2011

(65) Prior Publication Data

US 2011/0297174 A1 Dec. 8, 2011

Related U.S. Application Data

(60) Provisional application No. 61/351,359, filed on Jun. 4, 2010.

(51) Int. Cl.

| | |
|---|---|
| ***A45D 40/26*** | (2006.01) |
| ***A45D 34/04*** | (2006.01) |
| ***A46B 3/00*** | (2006.01) |
| ***A46B 5/00*** | (2006.01) |
| *A45D 40/18* | (2006.01) |

(52) U.S. Cl.

CPC ..... *A45D 40/262* (2013.01); *A45D 34/042* (2013.01); *A45D 40/18* (2013.01); *A45D 40/265* (2013.01); *A46B 3/005* (2013.01); *A46B 5/0033* (2013.01); *A46B 5/005* (2013.01); *A46B 5/0054* (2013.01); *A46B 2200/1053* (2013.01)

(58) Field of Classification Search

CPC .... A46B 9/021; A46B 5/0054; A46B 5/0075; A46B 5/0079; A46B 5/0083; A46B 2200/1046; A46B 5/005; A45D 40/262; A45D 34/042

USPC ..... 132/216, 218, 320; 401/121, 122, 126; D28/7; D4/133, 134

See application file for complete search history.

(56) References Cited

U.S. PATENT DOCUMENTS

| | | | | | |
|---|---|---|---|---|---|
| 823,725 | A | * | 6/1906 | Hayden | 15/114 |
| 1,367,385 | A | * | 2/1921 | Harrison | 15/202 |
| 1,664,797 | A | * | 4/1928 | Stone | 15/201 |
| 1,905,399 | A | * | 4/1933 | Wagner | 15/160 |
| 2,277,682 | A | * | 3/1942 | Brighton | 15/202 |
| 2,629,122 | A | * | 2/1953 | Den Uyl | 15/106 |
| 3,998,235 | A | * | 12/1976 | Kingsford | 132/218 |
| 4,194,848 | A | | 3/1980 | Kingsford | |
| 4,404,977 | A | * | 9/1983 | Vasas | 132/218 |
| 4,446,880 | A | * | 5/1984 | Gueret et al. | 132/218 |

(Continued)

FOREIGN PATENT DOCUMENTS

| | | | | |
|---|---|---|---|---|
| EP | 2266434 A1 | | 12/2010 | |
| FR | 2678494 A1 | * | 1/1993 | A45D 40/24 |

(Continued)

*Primary Examiner* — Robyn Doan
*Assistant Examiner* — Tatiana Nobrega
(74) *Attorney, Agent, or Firm* — David M. Joyal; Joan M. McGillycuddy

(57) ABSTRACT

An applicator for applying a cosmetic composition comprising an applicator element. The applicator element may be elongated along a longitudinal axis. The applicator has a first portion and a second portion separateable from the first portion and capable of moving independently from the first portion along the longitudinal axis. The first and/or second portions of the applicator element include means for holding a charge of cosmetic composition and transferring it to an integument on contact therewith.

15 Claims, 8 Drawing Sheets

(56) References Cited

U.S. PATENT DOCUMENTS

| | | | | |
|---|---|---|---|---|
| 4,458,701 | A * | 7/1984 | Holland | 132/218 |
| 4,498,490 | A * | 2/1985 | Seidler | 132/218 |
| 4,545,393 | A * | 10/1985 | Gueret et al. | 132/218 |
| 4,662,385 | A * | 5/1987 | Schefer | 132/218 |
| 5,007,442 | A * | 4/1991 | Hirzel | 132/218 |
| 5,109,877 | A | 5/1992 | Takeda | |
| 5,121,763 | A * | 6/1992 | Kingsford | 132/317 |
| 5,592,711 | A * | 1/1997 | Maier et al. | 15/106 |
| 6,962,160 | B2 * | 11/2005 | Dumler | 132/218 |
| 7,055,205 | B2 * | 6/2006 | Aoyama | 15/172 |
| 7,497,219 | B2 * | 3/2009 | Gueret | 132/218 |
| 8,079,373 | B2 * | 12/2011 | Wyatt et al. | 132/218 |
| 8,087,415 | B2 * | 1/2012 | Pires et al. | 132/218 |
| 2003/0115705 | A1 * | 6/2003 | Aoyama | 15/167.1 |
| 2003/0178043 | A1 * | 9/2003 | Gueret | 132/313 |
| 2005/0046087 | A1 | 3/2005 | De Laforcade | |
| 2006/0042647 | A1 * | 3/2006 | Vogel | 132/218 |
| 2007/0062551 | A1 * | 3/2007 | De Brouwer et al. | 132/218 |
| 2008/0193193 | A1 | 8/2008 | Pechko et al. | |
| 2009/0071499 | A1 * | 3/2009 | Wyatt et al. | 132/218 |
| 2009/0071500 | A1 * | 3/2009 | Wyatt et al. | 132/218 |
| 2009/0133708 | A1 * | 5/2009 | Myers | 132/218 |
| 2010/0083979 | A1 * | 4/2010 | Kim | 132/218 |
| 2010/0095975 | A1 * | 4/2010 | Kim | 132/217 |
| 2010/0186766 | A1 * | 7/2010 | Torii et al. | 132/218 |
| 2011/0123248 | A1 * | 5/2011 | Kim | 401/1 |
| 2011/0135376 | A1 * | 6/2011 | Weigel et al. | 401/29 |
| 2011/0297173 | A1 * | 12/2011 | Anderson et al. | 132/218 |
| 2012/0160262 | A1 * | 6/2012 | Tranchant et al. | 132/318 |
| 2012/0282008 | A1 * | 11/2012 | Geuther et al. | 401/122 |

FOREIGN PATENT DOCUMENTS

| | | | | |
|---|---|---|---|---|
| FR | 2701197 | A1 | 8/1994 | |
| WO | WO 2007114551 | A1 * | 10/2007 | A45D 40/26 |

* cited by examiner

COSMETIC APPLICATOR

CROSS REFERENCE TO RELATED APPLICATIONS

This application claims priority benefit, under 35 U.S.C. §119(e), of U.S. Provisional Patent Application No. 61/351,359, filed Jun. 4, 2010, the contents of which application are hereby incorporated by reference in their entirety.

FIELD OF INVENTION

The present invention relates generally to applicators for cosmetics. More particularly, the present invention relates to applicators for applying a cosmetic composition to eyelashes.

BACKGROUND OF THE INVENTION

Conventional applicators for applying mascara compositions to eyelashes generally include a brush having a single functionality. A regular or big size mascara brush, while being generally capable of depositing a cosmetic composition onto the eyelashes, lacks the ability or renders challenging to the user to apply the cosmetic composition in an accurate or detailed manner, particularly for reaching the bottom eyelashes or eyelashes in corners of the eye. Therefore, to improve the ability to apply cosmetic compositions in a precise and detailed manner, a user must carry a variety of applicators, which is burdensome to the user.

It is thus desirable to reduce the number of items needed by the user and provide a single cosmetic applicator having multiple parts capable of imparting different, cosmetically beneficial functionalities.

SUMMARY OF THE INVENTION

An applicator for applying a cosmetic composition having an applicator element is provided. The applicator element includes a first portion and a second portion separatable from the first portion. The first and second portions may be capable of moving independently from one another. The applicator element may be elongated along a longitudinal axis. The second portion may also be capable of moving independently from the first portion along the longitudinal axis. In certain embodiments, the applicator element may have a substantially cylindrical, rectangular, obloid, conical, spherical, prismatic, or lemniscoid shape. The first portion of the applicator element may include a cut-away therein suitably shaped to receive the second portion of the applicator element. Preferably, the first and second portions together form a substantially uniform cross-sectional profile of the applicator element.

The first and/or second portion of the applicator element may have a textured or smooth surface for holding a charge of cosmetic composition and transferring it to an integument on contact therewith. The textured or smooth surface may be bristles, projections, indentations, fins, tines, VELCRO® (hook and loop-type fasteners), teeth, grooves, sponges, foam, flocked surfaces and smooth surfaces. Preferably, the first portion of the applicator element has a textured surface composed of a plurality of bristles from the surface of said applicator element.

In certain embodiments, the second portion of the applicator element comprises at least a portion of the terminal end of the applicator element. Alternatively, the second portion of the applicator element comprises the terminal end of said applicator element. In another embodiment, the second portion of the applicator element is coaxial with the first, portion of the applicator element.

In some embodiments, a handle is fixed to the first portion of the applicator element. The first portion cannot move in a longitudinal direction with respect to the handle. In an alternative embodiment, the second portion cannot move in a longitudinal direction with respect to the handle. The handle may include a cap that is capable of being reversibly secured to a container of cosmetic composition and a rod secured to the cap at one end thereof and secured to the fixed portion of the applicator element at the other end thereof. An actuating mechanism may be disposed on or in the handle portion for moving the mobile portion along the longitudinal axis.

In another embodiment, an applicator for applying a cosmetic composition includes a first applicator element elongated along a longitudinal axis, and a second applicator element disposed within and coaxial to the first applicator element. The outer surfaces of the first and second applicator elements are separatable from one another and capable of moving independently from one another along the longitudinal axis. In certain embodiments, the second applicator element includes a cosmetic pencil or a brush, which retracts into said first applicator element when said second application element is in a fully retracted position. In other embodiments, the second applicator element includes a cosmetic pencil or a brush, which is in contact with at least one outer surface of said first applicator element when said second application element is in a fully retracted position.

A cosmetic product including the applicator of the present invention and a container charged with a cosmetic composition to which a cap is capable of being reversibly secured. The container may be configured to receive the applicator element when inserted into the container. A wiper may be attached to the container for removing excess cosmetic composition from the first portion and/or the second portion of the applicator element upon removal of the applicator from the reservoir. The wiper may be dimensioned to remove excess cosmetic composition from the first and second applicator element portions when the applicator is removed from the container. In certain embodiments, the wiper includes a constriction in the opening of the container, which may be annular or any other shaped opening that generally matches the cross-section of the applicator.

These and other aspects of the invention will become apparent to those skilled in the art after a reading of the following detailed description of the invention, including the figures and appended claims.

DETAILED DESCRIPTION

The inventive applicator includes at least two portions that articulate along a common axis. These portions provide different functionalities to improve application of a cosmetic composition or to impart an aesthetically pleasing grooming effect, without the need for a user to carry and use separate and distinct devices. For example, in an exemplary mascara brush according to the present invention, the applicator may include a portion for generally applying a mascara composition and an independently articulate portion that extends out from the applicator for detail application of the mascara composition to the corners of the eye and/or to the lower lashes, which allows for improved application of a cosmetic composition, without the need for a user to utilize and carry separate devices.

The inventive applicator for applying a cosmetic composition generally includes an elongated applicator element having at least two portions. The applicator elements are suitable for applying a cosmetic composition to an integument or to any keratinous fibers and may also be suitable for imparting a grooming effect to further improve the aesthetic appearance of the integument or keratinous fibers. Specifically, the applicator according to the invention may include elements suitable for different functionalities so as to improve application of a cosmetic composition and/or to impart different grooming effects. The applicator according to the invention may also be useful for application of a variety of cosmetic and personal care products to keratin fibers or to the skin, including without limitation, eyeliner, eyeshadow, concealer, foundation, lipliner, lipstick, lipcolor, lip gloss, etc. In particular, the applicator according to the invention is useful for application of an eyelash composition to the eye, including without limitation, pigmented and unpigmented mascaras, pharmaceutically and/or cosmeceutically active eyelash compositions, one or more parts of a multi-component mascara formulation, or a combination thereof. The applicator according to the invention may also be useful as a grooming device. Specifically, the device according to the invention may also be useful for combing, brushing and/or styling keratin fibers. As used herein, the term "keratin fibers" may include, without limitation, eyelashes, eyebrows, or hair of any part of the body.

Figure 1:
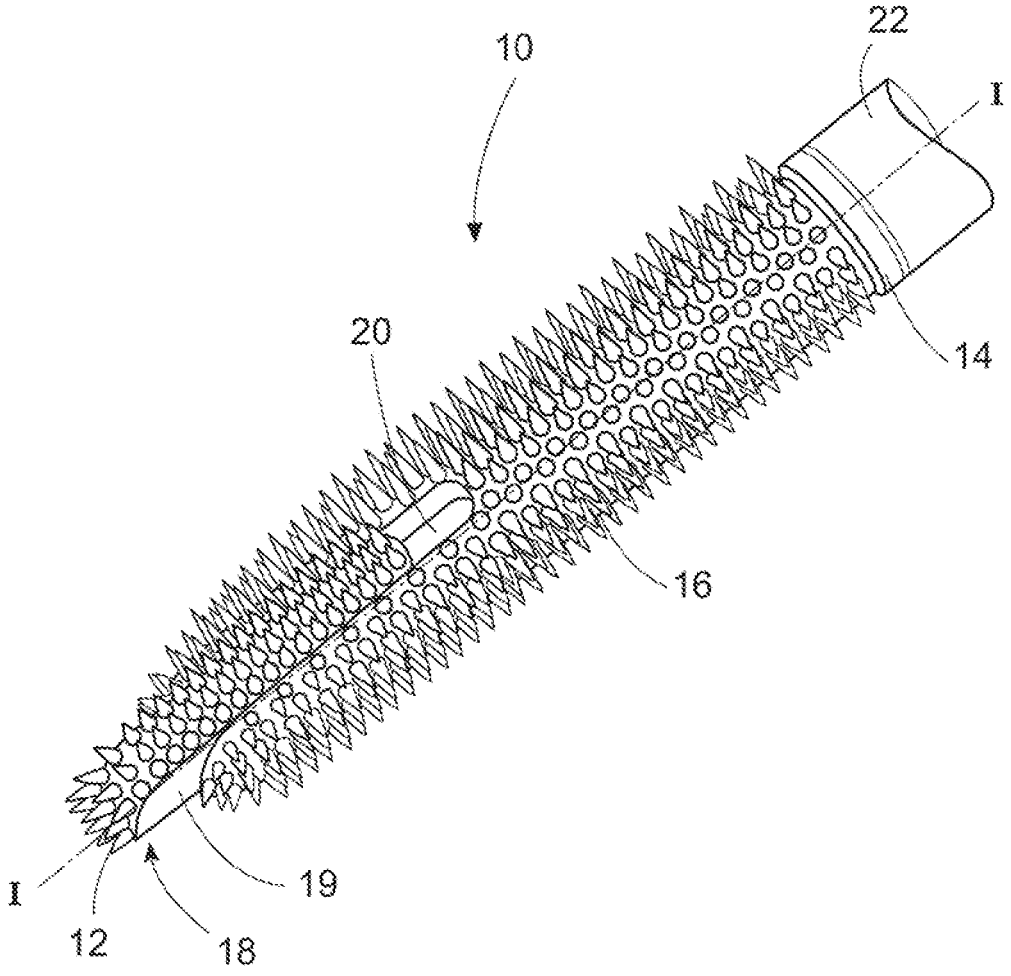
FIG. 1 shows an exemplary embodiment of the applicator according to the present invention having a portion along a longitudinal axis and has a width extending from an exterior surface to the longitudinal axis that is capable of independently moving along the longitudinal axis.

Some of the currently preferred embodiments of the applicator according to the invention are shown in FIGS. 1-5. The applicator includes an applicator element 10 having a proximal end 14 and a distal end 12. The applicator element 10 may have at least two portions, a first portion 16 and a second portion 18 separable from the first portion 16. The second portion 18 may be capable of moving along the longitudinal axis I-I of the applicator element 10, independent from the first portion 16. Preferably, the second portion 18 comprises at least a portion of a distal end 12 of the applicator element 10. In some embodiments, the first portion 16 is coaxial with the second portion 18 of the applicator element 10. The second portion 18 may extend away from the first portion 16 in a distal direction of the applicator element 10 and retract towards the first portion 16 of the applicator element 10 in a proximal direction. Alternatively, the first portion 16 may extend away from the second portion 18 in a proximal direction and retract towards the second portion 18 in a distal direction. In a particular embodiment, the first portion 16 and the second portion 18 of the applicator element 10 may be fitted together to provide an applicator element 10 having a substantially uniform shape. Preferably, the first portion 16 and the second portion 18 may be fitted together to provide a substantially uniform cross-sectional profile. In certain embodiments, the first portion 16 has a cut-away 20 therein suitably shaped to received the second portion 18 of the applicator element 10, when the portions are brought together. For example, the second portion 18 may be capable of extending away from the first portion 16 in a distal direction and also capable of retracting to fit within the cut-away 20 by moving along the longitudinal axis I-I in a proximal direction. In certain embodiments, the cut-away 20 may be in a beveled and/or tapered shape for eliminating and/or scraping excess cosmetic composition from the surfaces 19 of the second portion 18 of the applicator element 10. The surfaces 19 are on the exterior of the second portion 18, but are hidden from view in the interior of applicator element 10 when the second portion 18 is fully retracted. In FIG. 1, it will be understood that the second portion 18 refers to the entire piece that extends and retracts, including the outer surface, whereas 19 refers only to the indicated surface which, in the embodiment of FIG. 1, is hidden from view when the second portion 18 is fully retracted, and may be partially or completely visible when second portion 18 is extended.

In addition, the applicator element 10 may be attached to any suitable handle 22 (which may include a cap and rod assembly) that permits the user to hold and manipulate the applicator with the hand or fingers. In particular, the size and shape of the handle 22 permits the user to hold the handle 22 between the thumb and forefingers and manipulate the applicator for application of a mascara composition to the eyelashes. Alternatively, the size and shape of the handle 22 permits the user to hold the handle 22 within the palm of the hand and manipulate the applicator to engage keratinous fibers or hairs for imparting a grooming effect.

In certain embodiments, the handle 22 may be fixably attached to the first portion 16 of the applicator element 10, wherein the first portion 16 cannot move in a longitudinal direction with respect to the handle 22 and the second portion 18 may be capable of moving along the longitudinal axis I-I independent from the handle 22. In other embodiments, the handle 22 may be fixably attached to the second portion 18 of the applicator element 10, wherein the second portion 18 cannot move in a longitudinal direction with respect to the handle 22 and the first portion 16 may be capable of moving along the longitudinal axis I-I independent from the handle 22.

The handle 22 may also include an actuating mechanism 23 disposed on or in the handle for moving either a first portion 16 or a second portion 18 of the applicator element 10 along the longitudinal axis I-I. Specifically, if the handle 22 is attached to the first portion 16 of the applicator element 10 such that the first portion 16 cannot move in a longitudinal direction with respect to the handle 22, then the actuating mechanism 23 is capable of moving the second portion 18 along the longitudinal axis I-I. In contrast, if the handle 22 is attached to the second portion 18 of the applicator element 10 such that the second portion 18 cannot move in a longitudinal direction with respect to the handle 22, then the actuating mechanism is capable of moving the first portion 16 along the longitudinal axis I-I. The actuating mechanism 23 may include any suitable mechanism known in the art, including, for example, a push button, a trigger, a lever, a twist dial, etc. The actuating mechanism 23 may be attached to a spring assembly or to a manual control that allows the user to advance or retract the independently moveable portion of the applicator element 10, all at once or in an incremental manner. In FIGS. 1-4, 6 and 7, the complete handle and actuating mechanisms are not shown, although each of these embodiments contemplate a handle attached to the applicator element 10 and an actuating mechanism for moving the first portion 16 and/or the second portion 18 of the applicator element 10.

The applicator element 10 may have any suitable shape. The first portion 16 and the second portion 18 may be fitted together to form any substantially continuous curvilinear shape. Moreover, the first portion 16 and the second portion 18 of the applicator element 10 may be fitted together to have the shape of any conventional mascara brush. Specifically, the applicator element 10 may be elongated and/or curved. In particular, the applicator element 10 may have a cross-section along the longitudinal axis I-I of the applicator element 10 having the shape of an enclosed curve or a polygon, for example, a circle, oval, ellipse, triangle, square, rectangle, pentagon, hexagon, octagon, star, polygon, etc. Preferably, the applicator element 10 may have a substantially cylindrical, rectangular, obloid, conical, spherical, prismatic, or lemniscoid (e.g., peanut-shaped) shape.

FIG. 1 shows a specific embodiment of the applicator according to the present invention. The applicator element 10 as shown in FIG. 1 has a substantially cylindrical shape having a first portion 16 having a cut-away 20 parallel to the longitudinal axis I-I, the cut-away 20 being suitable for receiving a second portion 18 of the applicator element 10. The cut-away 20 may be symmetrical or asymmetrical. As shown in FIG. 1, the cut-away 20 may create one groove on the surface of the first portion 16 of the applicator element 10. Alternatively, the cut-away 20 may create two grooves on the surface of the first portion 16 of the applicator element 10. The cut-away 20 has a width extending from an exterior surface towards an interior portion of the applicator element 10. In the exemplary embodiment shown in FIG. 1, the cut-away 20 lies along the longitudinal axis I-I and has a width extending from an exterior surface to the longitudinal axis I-I. The second portion 18 of the applicator element 10 lies along the longitudinal axis I-I and comprises part of the distal end 12 of the applicator element 10. The first portion 16 and the second portion 18 may be fitted together to form a substantially cylindrical shape. In certain embodiments, the distal end 12 of the applicator element 10 may have a flat or angular shape. In other embodiments, the distal end 12 of the applicator element 10 may be rounded to form a curved shape. In the specific embodiment shown in FIG. 1, the distal end 12 of the applicator element 10 may be in the shape of a hemisphere, with the remainder of the applicator element 10 having a substantially cylindrical shape. However, it is contemplated that the distal end 12 of the applicator element 10 of the present invention may have any curvilinear shape.

Figure 2:
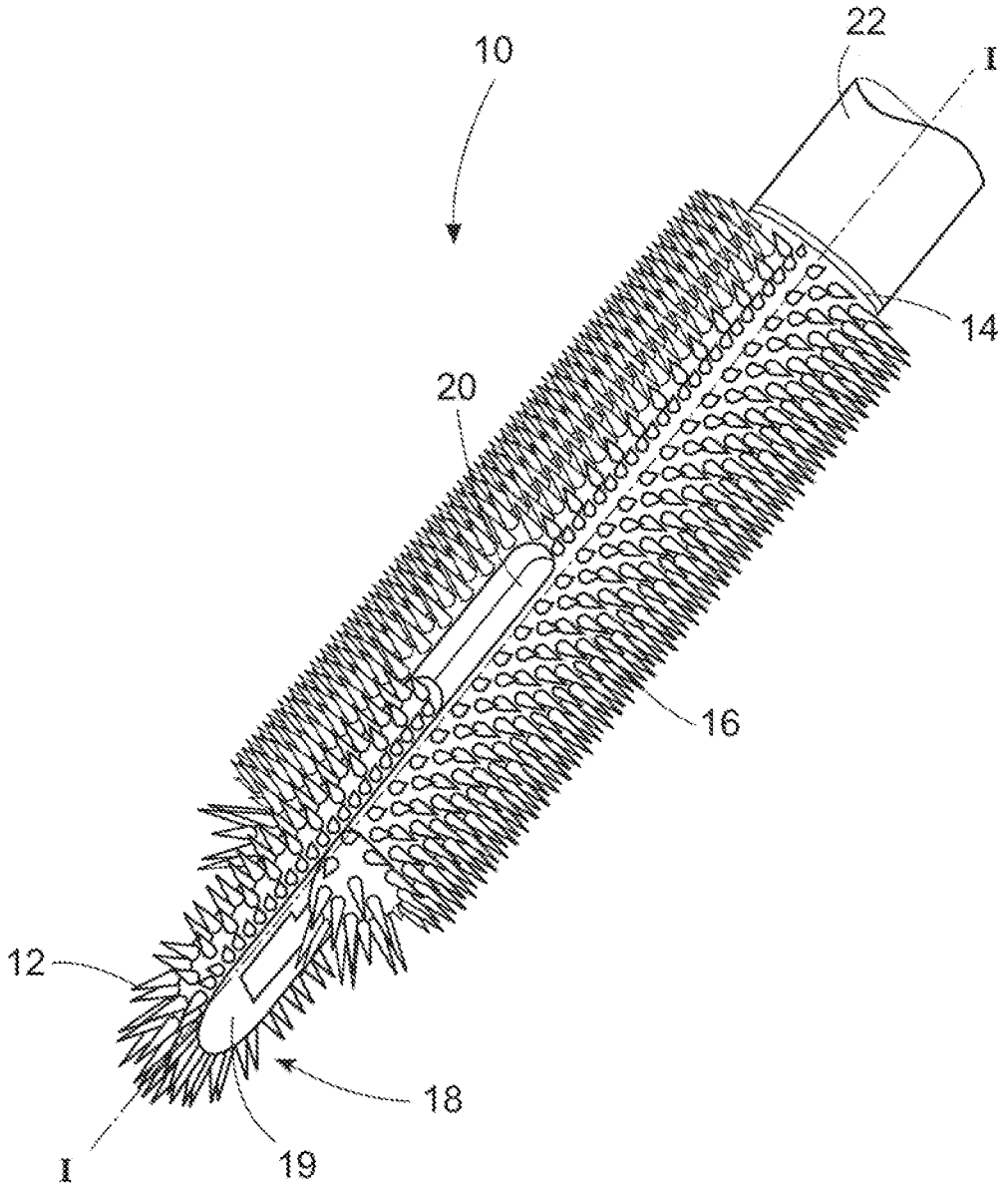
FIG. 2 shows an exemplary embodiment of the applicator according to the present invention having a symmetrical portion along a longitudinal cross-section of the applicator that is capable of independently moving along the longitudinal axis.

FIG. 2 shows another exemplary embodiment of the applicator according to the present invention. Similar to the applicator of FIG. 1, the applicator element 10 as shown in FIG. 2 also has a substantially cylindrical shape. The applicator element 10 includes a first portion 16 having a cut-away 20 parallel to the longitudinal axis I-I and along the longitudinal cross-section of the applicator, the cut-away 20 being suitable for receiving a second portion 18 of the applicator element 10. In this particular embodiment, the second portion 18 of the applicator element 10 includes a central axis that is coaxial with the longitudinal axis I-I of the applicator element 10. As shown in FIG. 2, the cut-away 20 creates two grooves on the surface of the first portion 16 of the applicator element 10. In this particular embodiment, the second portion 18 of the applicator element 10 forms part of the distal end 12 of the applicator element 10, and lies along the longitudinal cross section of the applicator element 10 at the distal end 12 and optionally along at least some of the length of applicator element 10. Similar to the embodiment shown in FIG. 1, the first portion 16 and the second portion 18 of the applicator element 10 of the exemplary embodiment of FIG. 2 may be fitted together to form a substantially cylindrical shape.

Figure 3:
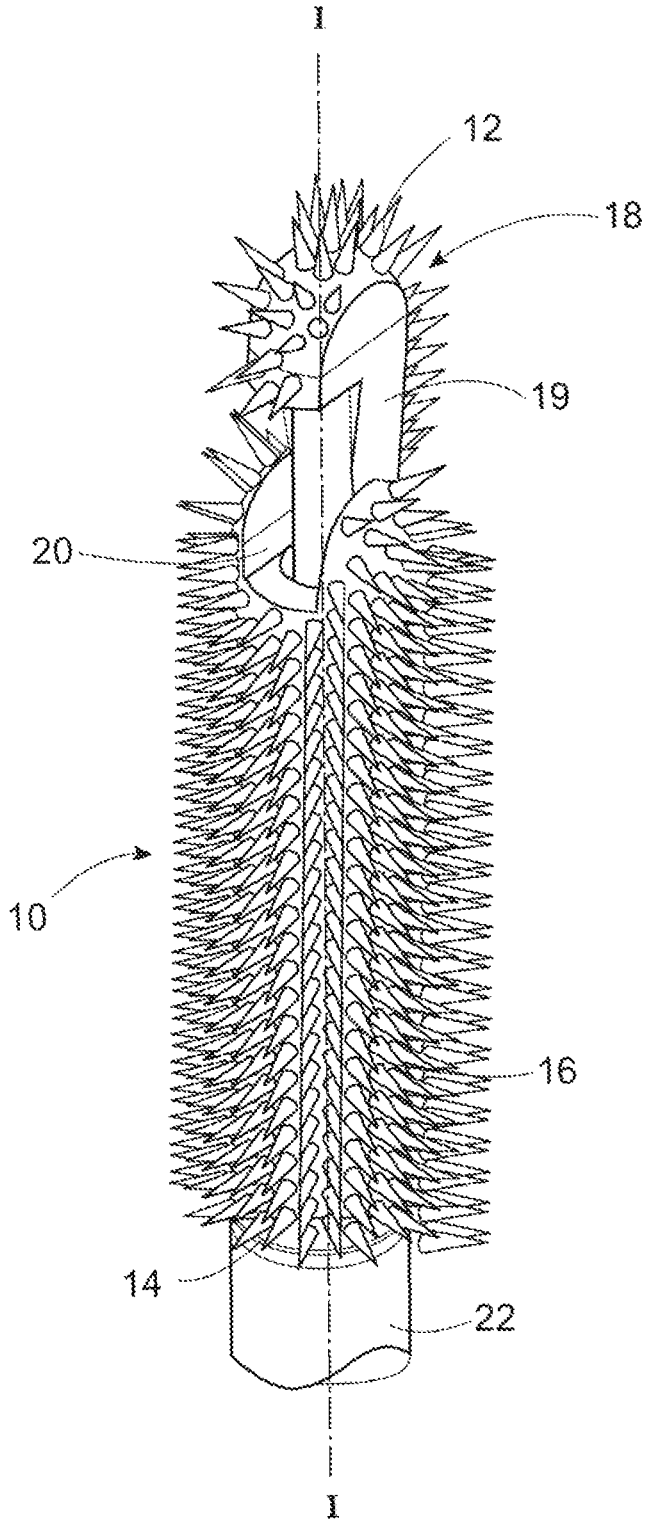
FIG. 3 shows an exemplary embodiment of the applicator according to the present invention having an asymmetrical portion along a longitudinal cross-section at the distal end and a portion at the proximal end along a longitudinal axis and has a width extending from an exterior surface of the applicator to the longitudinal axis that is capable of independently moving along the longitudinal axis.

FIG. 3 shows another exemplary embodiment of the applicator according to the present invention. Similar to the applicators of FIGS. 1 and 2, the applicator element 10 as shown in FIG. 3 also has a substantially cylindrical shape, but unlike FIG. 2, the cut-away 20 and second portion 18 are asymmetrically with respect to the opposing sides of the applicator. The applicator element 10 includes a first portion 16 having a cut-away 20 parallel to the longitudinal axis I-I, the cut-away 20 being suitable for receiving a second portion 18 of the applicator element 10. The second portion 18 of the applicator element 10 may have different cross sectional shapes along the longitudinal axis I-I. At the distal end 12 of the second portion 18, the second portion 18 lies along the longitudinal cross-section of the applicator element 10. However, towards the proximal end of the second portion 18, the second portion 18 becomes asymmetrical. As can be seen in FIG. 3, the proximal end of the second portion 18 lies along the longitudinal axis I-I and has a width extending from an exterior surface to the longitudinal axis I-I. It is contemplated that the size and shape of a cross-section of second portion 18 about the longitudinal axis I-I may change along different positions on the longitudinal axis I-I. A change from one cross-sectional size and shape may be gradual or may be in a discontinuous manner, which is shown in the exemplary embodiment of FIG. 3. Similar to the embodiments shown in FIGS. 1 and 2, the first portion 16 and the second portion 18 of the applicator element 10 of the exemplary embodiment of FIG. 3 may be fitted together to form a substantially cylindrical shape.

Figure 4:
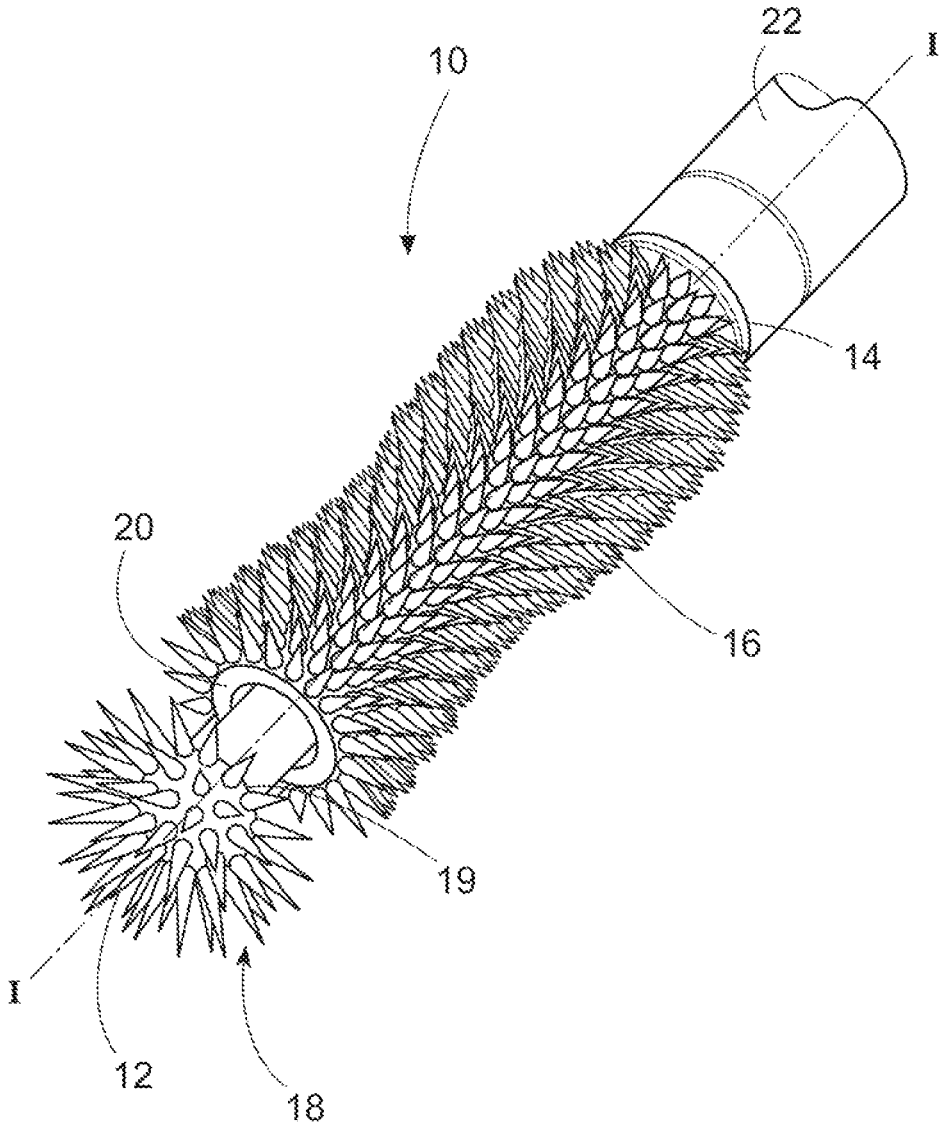
FIG. 4 shows an exemplary embodiment of the applicator according to the present invention having a portion encompassing the terminal distal end of the applicator element that is capable of independently moving along the longitudinal axis.

FIG. 4 shows an exemplary embodiment of the applicator according to the present invention having a second portion 18 that encompasses the distal end 12 of the applicator element 10. In this particular embodiment, the applicator element 10 has a substantially lemniscoid shape, including for example, a peanut shape. The applicator element 10 includes a first portion 16 and a second portion 18 that encompasses the distal end 12 of the applicator element 10. The second portion 18 is coaxial with the first portion 16 and capable of moving along the longitudinal axis I-I independently from the first portion 16. The second portion 18 may be fitted with the first portion 16 to form a uniform and continuous curvilinear shape, specifically the lemniscoid shape (e.g., peanut shape). In some embodiments, the distal end 12 of the applicator element 10 may be rounded to form a curved shape. Preferably, the second portion 18 of the applicator element 10 has a substantially hemispherical shape.

Figure 5:
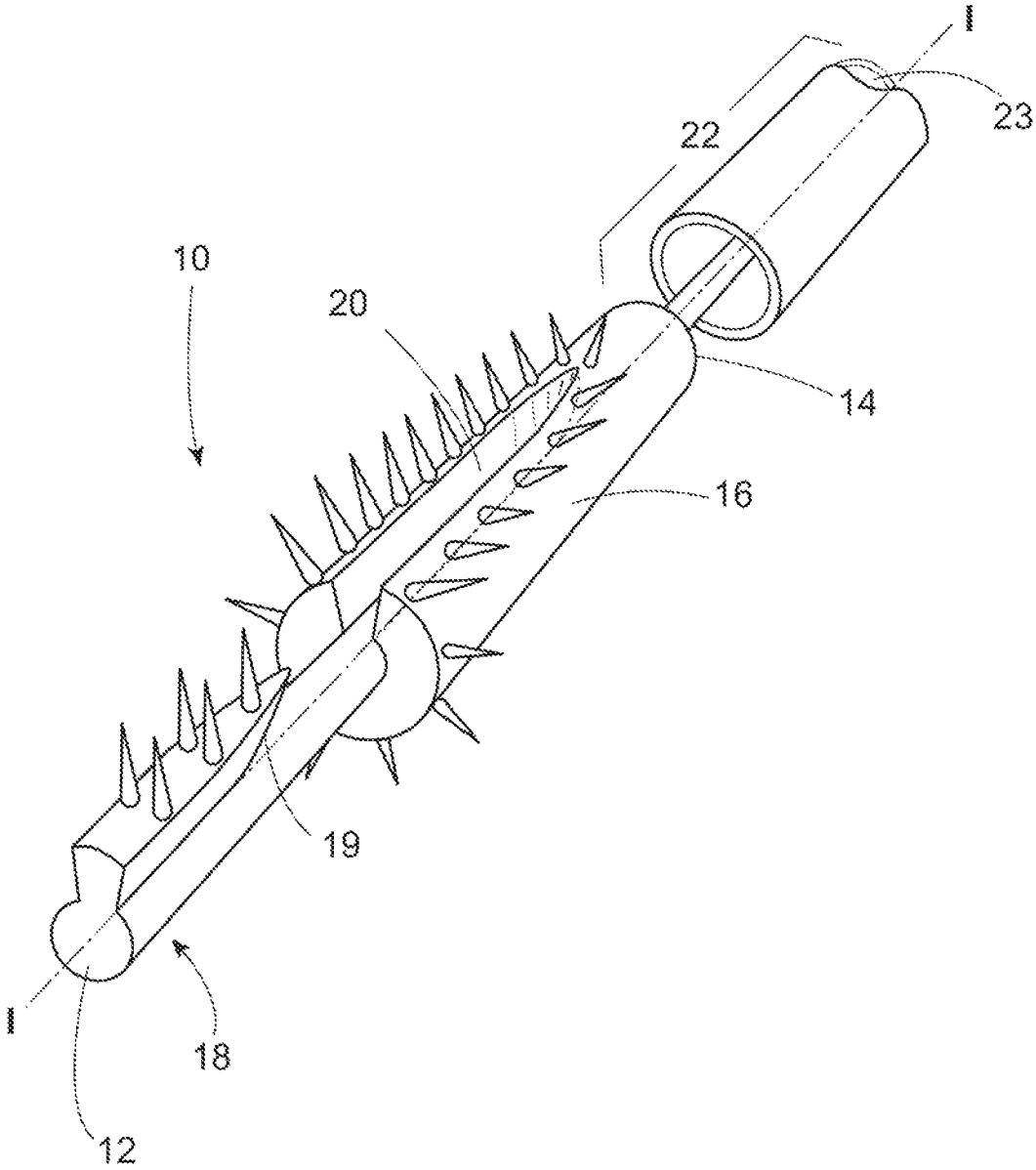
FIG. 5 shows an exemplary embodiment of the applicator according to the present invention having a portion along a longitudinal axis and has a width extending from an exterior surface to the longitudinal axis that is capable of independently moving along the longitudinal axis, and a beveled cut-away that is capable for eliminating excess cosmetic composition from the surfaces of said moveable portion.

FIG. 5 shows another exemplary embodiment of the applicator according to the present invention. Similar to the embodiment shown in FIG. 1, the applicator element 10 as shown in FIG. 5 has a substantially cylindrical shape, but instead has a flat distal end 12. The applicator element 10 shown in FIG. 5 has a first portion 16 having a cut-away 20 parallel to the longitudinal axis I-I and along a cross-sectional radius of the applicator element 10. The second portion 18 of the applicator element 10 lies along the longitudinal axis I-I and may be fitted into the cut-away 20 to form a uniform and continuous curvilinear shape with the first portion 16 of the applicator element 10. Preferably, as shown in FIG. 5, the cut-away 20 may have a beveled shape for eliminating excess cosmetic composition from the surfaces 19 of the second portion 18 of the applicator element 10. In particular, the cut-away 20 may be wide at the surface of the applicator element 10 and become tapered towards the longitudinal axis I-I of the applicator element 10. The cut-away 20 may also have a further tapered and/or beveled shape at the proximal end thereof to further eliminate excess cosmetic composition from the surfaces 19 of the second portion 18. Removal of excess cosmetic composition from the surfaces 19 of the second portion 18 of the applicator element 10 should reduce the amount build-up of cosmetic composition from regular use between the first portion 16 and the second portion 18 of the applicator element 10 and therefore improve and/or maintain the ability of the second portion 18 to move along the longitudinal axis I-I.

The first portion 16 and/or the second portion 18 of the applicator element 10, include means for holding and releasing a cosmetic composition, such as mascara, and can include any type of surface for holding a charge of cosmetic composition and transferring it to an integument on contact therewith. Specifically, the surface may transfer a cosmetic composition to a keratin fiber (e.g., eyelashes, hair of the scalp, lips, or the skin) on contact. Any suitable surfaces (e.g., textured or smooth) capable of holding and transferring a charge of cosmetic composition may be included in the first portion 16 and/or the section portion 18 of the applicator element 10. The surfaces may also be capable of imparting various types of aesthetically pleasing appearances to the keratin fibers, e.g., eyelashes or hair of the scalp, such as a volumized appearance, a separated appearance (i.e., the fibers being individually separated from each other), a curly appearance, etc. Examples of suitable textured surfaces include bristles, projections, indentations, fins, tines, VELCRO® (hook and loop-type fasteners), teeth, grooves, sponges, foam or flocked surfaces. The surfaces may be formed from any suitable substance. In some embodiments, the surfaces are formed from silicone or other soft touch materials. In other embodiments, the applicator may have no texture, for example a smooth surface, as would be the case for a spatula-type applicator, for example.

In a preferred embodiment, the textured surface is composed of a plurality of bristles extending from the surface of the first portion 16 and/or the second portion 18 of the applicator element 10. For example, the applicator element 10 may comprise a core having an elongated shape, e.g., a substantially cylindrical, rectangular, obloid, conical, spherical, prismatic, or lemniscoid (e.g., peanut-shaped) shape. The core may comprise any material suitable for holding a textured surface. In some exemplary embodiments, the core may comprise twisted wires having bristles contained within. In certain embodiments, the bristles may be fastened to the core in any manner known in the art including staple set, fuse, adhesive or molding methods. In an exemplary embodiment, the bristles may extend radially randomly, or otherwise, from the core. In other exemplary embodiments, the bristles may extend normal to the core. In some embodiments, the bristles are located at the distal end 12 of the applicator element 10, along a perimeter about the longitudinal axis I-I of the elongated applicator element 10, or a combination there of. In certain embodiments, the bristles are located solely at the distal end 12 of the applicator element 10. In other embodiments, the bristles are located solely along a perimeter about the longitudinal axis I-I of the elongated applicator element 10. Bristles according to one embodiment of the invention will typically be less than 50 mm in length, less than 30 mm in length, less than 20 mm in length, less than 10 mm in length, less than 7.5 mm in length, less than 5 mm in length, less than 2.5 mm in length. In one embodiment, the bristles are between 0.1 mm and 1 mm in length. The bristles may be formed so that some or all of the bristles have a varying diameter, length, or cross-sectional shape. For example, some bristles may have one diameter, length, and/or shape and other bristles will have another diameter, length and/or shape. Also, the cross-sectional shape or diameter of individual bristles may change along their length. The bristles may be, without limitation, integral with the first portion 16 and/or the second portion 18 of the applicator element 10 or may be synthetic or natural fibers implanted therein.

In one preferred embodiment, the texture surface may comprise an array of stub-like projection, fin-like projections, and/or bristles arranged in any suitable shape or pattern and need not be symmetrical. Examples of suitable patterns include spaced and parallel rows, staggered rows and columns, linear rows and columns, or random patterns. The density of the array may vary depending on the characteristics of the cosmetic composition being applied. Differences in the densities of the array of projections may also impart different aesthetic looks to the keratin fibers, e.g., eyelashes.

Figure 6:
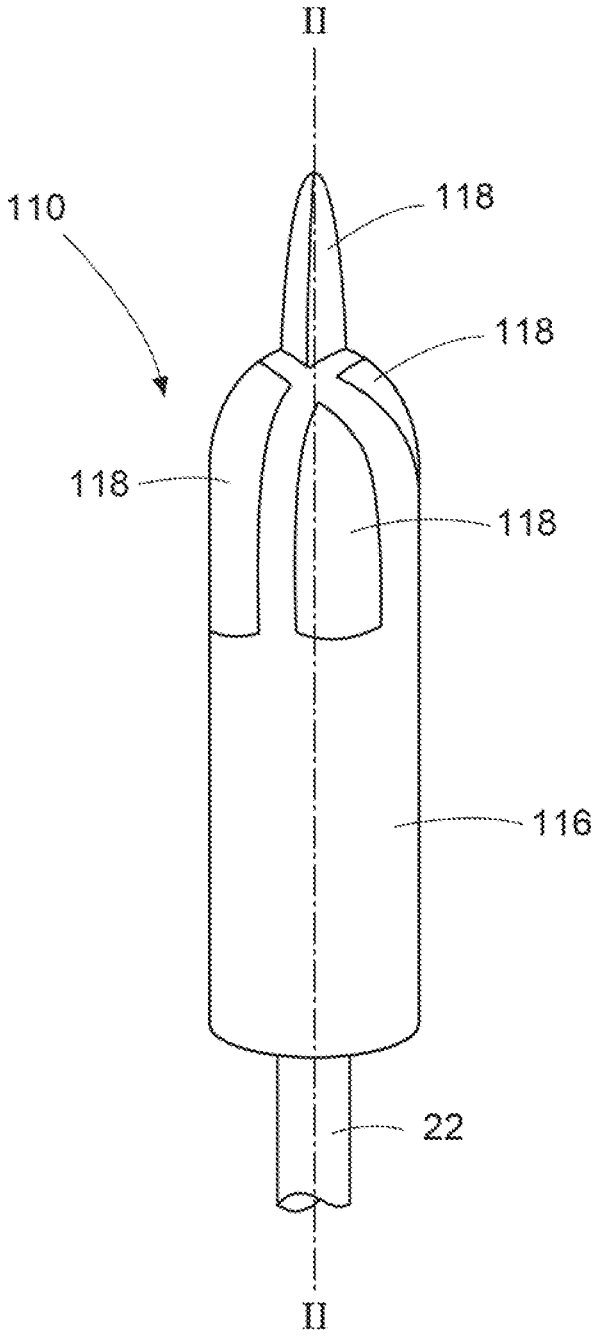
FIG. 6 shows an exemplary embodiment of the applicator according to the present invention having a plurality of portions capable of independently moving along the longitudinal axis.

In other embodiments of the applicator according to the present invention, as shown in FIG. 6, the applicator element 110 may have a plurality of portions that move independently along the longitudinal axis II-II. Specifically, the applicator element 110 may have a fixed portion 116 attached to a handle 22, such that the fixed portion 116 cannot move in a longitudinal direction with respect to said handle 22, and a plurality of moveable portions 118 separable from the fixed portion 116 that is capable of moving along the longitudinal axis II-II of the applicator element 110, independent from the fixed portion 116 or from other moveable portions 118. The applicator element 110 may comprise at least 1, at least 2, at least 3, at least 4, at least 5, at least 6, at least 7, at least 8, at least 9 or at least 10 moveable portions 118. In some embodiments, at least two, or at least three or more, of the moveable portions 118 can move together, in concert or otherwise, and in the same or different directions, with respect to the fixed portion 116. The fixed portion 116 and/or each of the plurality of moveable portions 118 may include means for holding and releasing a cosmetic composition, such as mascara, and can include any type of textured surface for holding a charge of cosmetic composition and transferring it to an integument on contact therewith. Specifically, the fixed portion 116 and each of the plurality of moveable portions 118 may each independently impart a cosmetically beneficial functionality to improve application of a cosmetic composition and/or a grooming effect. For example, the fixed portion 116 and each of the plurality of moveable portions 118 may each independently select from any type of textured surface for holding a charge of cosmetic composition and transferring it to an integument on contact therewith, such as, for example, of bristles, projections, indentations, fins, tines, VELCRO® (hook and loop-type fasteners), teeth, grooves, sponges, foam, flocked surfaces, and smooth surfaces.

Figure 7A:
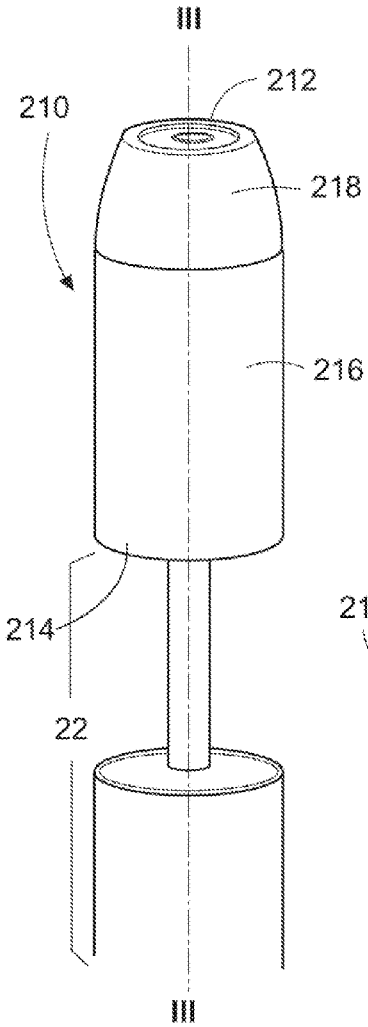
FIGS. 7A, 7B and 7C shows three different configurations of an exemplary embodiment of the applicator according to the present invention having a first portion, a second portion, and a third portion, each of which may move independently from the other portions along the longitudinal axis.
Figure 7B:
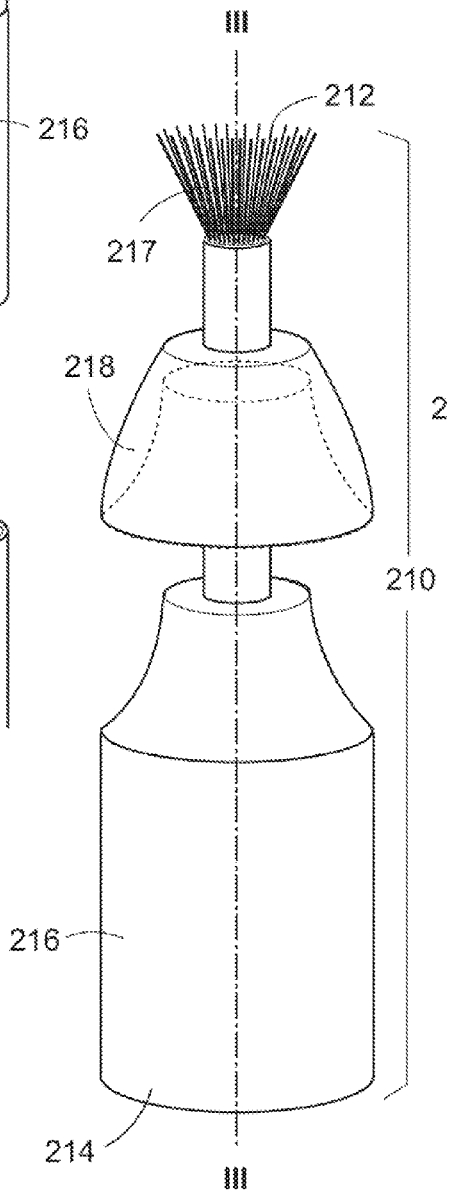
Figure 7C:
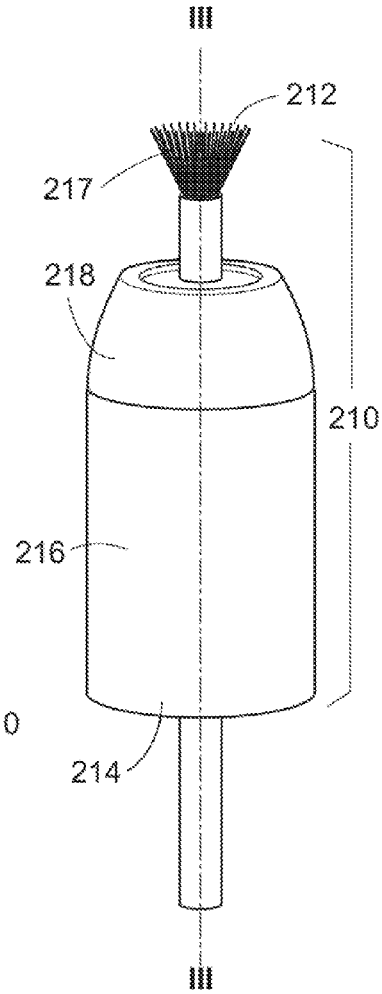

In another alternative embodiment, the applicator according to the present invention, as shown in three different arrangements in FIGS. 7A, 7B and 7C, comprises an applicator 210 having a proximal end 214 and a distal end 212. The applicator 210 may comprise a first portion 216, a second portion 218, and a third portion 217, each of which may move independently from the other portions along the longitudinal axis III-III. The applicator 210 includes a first applicator portion 216 elongated along the longitudinal axis III-III and having a distal end 212 and a proximal end 214 and a second portion 218 coaxial with and separable from the first portion 216. The first portion 216 and the second 218 portion, when fitted together (FIGS. 7A and 7C) provide a substantially uniform shape, particularly a substantially cylindrical shape, and define an elongated lumen therein. The third portion 217 may also have an elongated shape and may be coaxial with the first and second portions 216, 218. Specifically, the lumen of the first and second portions 216, 218 may be capable of receiving at least a portion of the third portion 217 therein. For example, the third portion 217 may be capable of extending away from the first and second portions 216, 218 in a distal direction and also capable of retracting to partially, but not completely, fit within the lumen by moving along the longitudinal axis III-III in a proximal direction. Alternatively, the third portion 217 may be capable of retracting completely within the lumen. In a preferred embodiment, the first and second portions 216, 218 may provide a full or partial sheath over the third portion 217 in a fully retracted configuration. In another embodiment, the third portion 217 is in contact with at least one outer surface of the first portion 216 or the second portion 218 when the third portion 217 is in a fully retracted configuration.

The third portion 217 may comprise, for example, a cosmetic pencil (e.g., lip liner, eyeliner, eyebrow pencil, etc.), a brush (e.g., an eyeliner brush, an eyeshadow brush, a mascara brush, a concealer brush, etc.), a lipstick, a concealer stick, a comb, a sponge applicator, a foam applicator, and the like, that either fit completely within the lumen, or do not completely fit within the lumen of the first and second portions 216, 218. Preferably, the third portion 217 is a cosmetic pencil or a brush, which retracts into the first portion 216 or the second portion 218 when the third portion 217 is in a fully retracted configuration, as shown in FIG. 7A. In some embodiments, the third portion 217 may be suitably shaped to be in contact with at least one outer surface of the the first portion 216 or the second portion 218 when the third portion 217 is in a fully retracted configuration.

In another alternative embodiment, the applicator according to the present invention, comprises at least two applicator elements that move independently along the longitudinal axis. The applicator includes a first applicator element elongated along the longitudinal axis and having a proximal end and a distal end; and a second applicator element capable of moving independently from the first applicator element along the longitudinal axis. Preferably, the first applicator element is coaxial with the second applicator element about the longitudinal axis. The first applicator element may define a lumen therein for receiving a second applicator element. Specifically, the first applicator element may include a substantially cylindrical lumen therein along the longitudinal axis for receiving the second applicator element. For example, the second applicator element may be capable of extending away from the first applicator element in a distal direction and also capable of retracting in a proximal direction to partially, but not completely, fit within the lumen, or may completely fit within the lumen, of the first applicator element. In a preferred embodiment, the first applicator element may provide a partial sheath over the second applicator element in a fully retracted configuration. In another embodiment, the second applicator element is in contact with at least one outer surface of the first applicator element when the second application element is in a fully retracted position.

The second applicator element may also have an elongated shape along the longitudinal axis. The second applicator element may comprise any elongated cosmetic applicator that is suitably shaped to be in contact with at least one outer surface of the first applicator element when the second application element is in a fully retracted position. Suitable examples for a second applicator element include, for example, a cosmetic pencil (e.g., lip liner, eyeliner, eyebrow pencil, etc.), a brush (e.g., an eyeliner brush, an eyeshadow brush, a mascara brush, a concealer brush, etc.), a lipstick, a concealer stick, a comb, a sponge applicator, a foam applicator, and the like, that do not completely fit within the lumen of the first applicator element. Preferably, the second applicator element is a cosmetic pencil or a brush, suitably shaped to be in contact with at least one outer surface of the first applicator element when the second application element is in a fully retracted position.

The cosmetic applicator of the present invention may be placed in a kit with or used in combination with a container 30 charged with a cosmetic composition, which can include a variety of cosmetic and personal care products to keratin fibers or to the skin, including without limitation, eyeliner, eyeshadow, concealer, foundation, hair dye, lipliner, lipstick, lipcolor, lip gloss, etc. In some embodiments, the cosmetic composition is a liquid, viscous liquid, semi-solid, or solid cosmetic composition. Preferably, the cosmetic composition is an eyelash composition, a lip composition or eyelid composition. More preferably, the cosmetic composition is an eyelash composition to the eye, including without limitation, pigmented and unpigmented mascaras, pharmaceutically and/or cosmeceutically active eyelash compositions, one or more parts of a multi-component mascara formulation, or a combination thereof.

Figure 8:
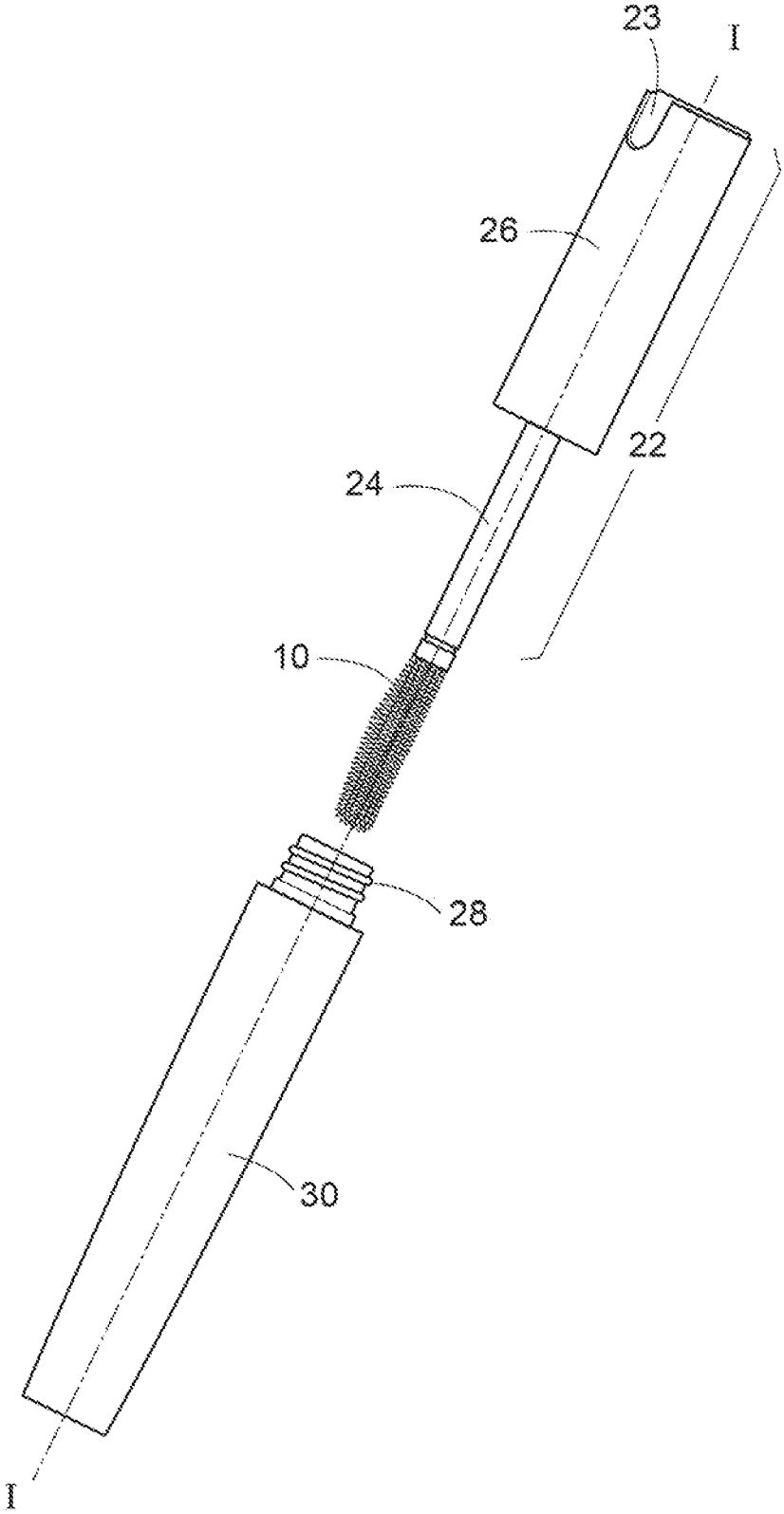
FIG. 8 shows an exemplary embodiment of a cosmetic product comprising the applicator according to the present invention.

In the particular embodiment shown in FIG. 8, the applicator element 10 is attached to a handle 22, which encompasses a cap 26 capable of being reversibly secured to a container 30 and a rod 24 secured to the cap 26 at a proximal end thereof and secured to the applicator element 10 at the other end thereof. The rod 24 may be secured to a first portion (not shown) of the applicator element 10 and allowing a second portion (not shown) of the applicator element 10 to independently move from the rod 24 along the longitudinal axis I-I. Alternatively, the rod 24 may be secured to the second portion of the applicator element 10 and allowing the first portion of the applicator element 10 to independently move from the rod 24 along the longitudinal axis I-I.

The rod 24 may have an elongated shape and may have a solid or hollow interior. For example, the rod 24 may be in the shape of a solid elongated cylinder, a hollow elongated cylinder comprising a cylindrical space therein concentric with a longitudinal axis of the rod, or the rod may have an irregular cross section, a U-shaped cross section, or the like. Other suitable shapes for the rod 24 may include solid or hollow elongated shapes having a cross sectional shape of an enclosed curve or a polygon, for example, a circle, oval, ellipse, triangle, square, rectangle, pentagon, hexagon, octagon, star polygon, etc. In addition, the rod 24 may be made of any suitable material such that the rod 24 is flexible, semi-flexible, rigid, or semi-rigid.

The cap 26 is preferably sized to fit over a portion of the container 30 and capable of reversibly engaging a neck portion 28 of the container 30 using any suitable reversible connector mechanism. In a preferred embodiment, the neck portion 28 and the cap 26 have complementary threads. In another embodiment, the neck portion 28 may include a notch and the cap portion may include a corresponding depression for engaging the notch. In some embodiments, engaging the cap 26 with the neck portion 28 of the container 30 triggers a trip mechanism (not shown) that actuates or retracts the mobile portion or portions, if the mobile portion(s) are not already fitted together with the fixed portion. In one particular embodiments, engaging the cap 26 with the neck portion 28 of the container 30 triggers a trip mechanism (not shown) that actuates or retracts the second portion (not shown) in a proximal direction 14, if the second portion (not shown) is not already fitted together with the first portion 16. In a different embodiment, engaging the cap 26 with the neck portion 28 of the container 30 triggers a trip mechanism (not shown) that actuates or retracts the first portion (not shown) in a distal direction 12, if the first portion (not shown) is not already fitted together with the second portion 18. In one embodiment, the trip mechanism is located on the neck portion 28 of the container 30. In another embodiment, the trip mechanism is located on the cap 26, preferably an interior surface of the cap 26, or may be located on the rod 24.

The container 30 may also include at least one wiper for removing excess cosmetic composition from the applicator element 10. The applicator may be used in combination with the container 30 by first placing the applicator element 10 into the container 30 so as to bring the applicator element 10 into contact with the cosmetic composition and subsequently withdrawing the applicator element 10 from the container 30 to meter a charge of cosmetic composition onto the applicator element 10. While the applicator element 10 is being withdrawn from the container 30, the wiper removes excess cosmetic composition from the applicator element 10 by a smoothing motion and pushing the excess cosmetic composition back into the container 30.

The wiper may be attached to or is an integral part of an interior or an exterior surface of the container 30 and capable of removing excess cosmetic composition from the first portion 16 and/or the second portion 18 of the applicator element 10. In some embodiments, the wiper may be attached to or is an integral part of an opening of the container 30. Preferably, the wiper is attached to the neck 28 of the container 30. In a particular embodiment, the wiper is attached to the exterior surface at the end of the neck 28 of the container 30. In other embodiments, the wiper may be fitted into or be a part of the opening at the neck 28 of the container 30. In another embodiments, the wiper may be attached to or is an integral part of an interior surface of the container 30. It is contemplated that the wiper may have any suitable size and/or shape. Preferably, the wiper is suitably sized and/or shaped to be capable of removing excess cosmetic composition from both the first portion 16 and the second portion 18 with a single motion when the applicator is removed from the container 30. In one embodiment, the wiper has a substantially circular shape. In another embodiment, the wiper has a shape that generally matches the cross-section of the applicator. In another embodiment, the wiper comprises an annular constriction in the opening at the neck 28 of the container 30.

Preferably the kit, including the applicator element 10, the handle 22, the cap 26 and the container 30, may be made from plastic, metal, and/or thermoplastic elastomers, rubber, manufactured using injection and/or injection blow molding, and assembled by snap-fit assembly. However, it is contemplated that any other material, manufacturing, and/or assembly method may also be used. In particular, the cap 26 and the container 30 may be made with anodized plastic materials to provide a metallic look.

The invention described and claimed herein is not to be limited in scope by the specific embodiments herein disclosed since these embodiments are intended as illustrations of several aspects of this invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All publications cited herein are incorporated by reference in their entirety.

What is claimed:

1. An applicator for applying a cosmetic composition comprising:

an applicator element elongated along a longitudinal axis comprising a first portion having an outer surface and a second independently articulated portion having an outer surface, the second portion forming the distal end of said applicator element and capable of extending out from the applicator, wherein the outer surfaces of said first and second portions are separable from one another and capable of moving independently from one another, wherein said first portion is capable of moving independently from said second portion along said longitudinal axis so that the second portion is capable of extending away from the first portion in a distal direction and retracting in a proximal direction by moving along the longitudinal axis, a handle fixed to said first portion of said applicator element, such that said first portion cannot move in a longitudinal direction with respect to said handle, wherein said handle portion comprises a rod secured to a cap at one end thereof and secured to said first portion of said applicator element at the other end thereof, said cap capable of being reversibly secured to a container of cosmetic composition, and wherein said first portion comprises a lumen for receiving said second portion such that said second portion can retract partially but not completely into said lumen, wherein each of said first and second portions of said applicator element comprise a textured surface for holding a charge of cosmetic composition and transferring it to an integument on contact therewith, wherein the textured surface of each of the first and second portions of said applicator element is independently selected from the group consisting of bristles, fins, tines, teeth, sponges, foam and flocked surfaces.

2. The applicator according to claim 1, wherein said applicator element has a substantially cylindrical, rectangular, obloid, conical, spherical, prismatic, or lemniscoid shape.

3. The applicator according to claim 1, wherein the textured surface of the first portion of said applicator element is composed of a plurality of bristles from the surface of said applicator element.

4. The applicator according to claim 3, wherein the textured surface of the second portion of said applicator element is composed of a plurality of bristles from the surface of said applicator element.

5. The applicator according to claim 1, wherein said cap comprises a trip mechanism that actuates said second portion when said cap is engaged with a container.

6. The applicator according to claim 1, further comprising:

an actuating mechanism disposed on or in said handle portion for moving said second portion along said longitudinal axis.

7. The applicator according to claim 1, wherein said second portion of said applicator element comprises at least a portion of the terminal end of said applicator element.

8. The applicator according to claim 1, wherein said first portion of said applicator element comprises a cut-away therein suitably shaped to receive said second portion of said applicator element.

9. The applicator according to claim 8, wherein said first and second portions together form a substantially uniform cross-sectional profile of said applicator element.

10. The applicator according to claim 1, wherein said second portion of said applicator element is coaxial with said first portion of said applicator element.

11. A cosmetic product comprising the applicator according to claim 1 and a container charged with a cosmetic composition to which said cap is capable of being reversibly secured, said container being configured to receive said applicator element when inserted into said container, and a wiper attached to said container for removing excess cosmetic composition from said first portion and/or said second portion of said applicator element upon removal of the applicator from a reservoir.

12. The cosmetic product according to claim 11, wherein said cosmetic composition is an eyelash composition, lip composition or eyelid composition.

13. The cosmetic product according to claim 11, wherein said wiper comprises an annular constriction in an opening of said container.

14. The cosmetic product according to claim 11, wherein said wiper is dimensioned to remove said cosmetic composition from said first and second applicator element portions when said applicator is removed from the container.

15. The applicator according to claim 1, wherein said second applicator element comprises a brush, which is in contact with at least one outer surface of said first applicator element when said second application element is in a fully retracted position.

* * * * *